US006041443A

United States Patent [19]

Pas et al.

[11] Patent Number: 6,041,443

[45] Date of Patent: Mar. 28, 2000

[54] SOCK

[76] Inventors: Bob Pas, Herenlaan 45, NL-3701 AS, Zeist; Paulus Ernst Gerardus Berkelaar, Baron van Brakellstraat 10, NL-4023 AG, Rijswijk, both of Netherlands

[21] Appl. No.: 09/083,971

[22] Filed: May 26, 1998

[30] Foreign Application Priority Data

May 26, 1997 [NL] Netherlands ..... 1006127

[51] Int. Cl.[7] ..... A41B 11/00

[52] U.S. Cl. ..... 2/239; 36/9 R; 36/10

[58] Field of Search ..... 2/239, 61, 22, 2/240, 241, 67; 36/4, 10, 7.3, 87, 9 R, 102, 11, 32 R

[56] References Cited

U.S. PATENT DOCUMENTS

| | | | |
|---|---|---|---|
| 318,949 | 6/1885 | Brown | 36/4 |
| 528,473 | 10/1894 | Girard | 36/4 |
| 545,130 | 8/1895 | McKechnie | 36/4 |
| 554,468 | 2/1896 | Very | 36/4 |
| 1,972,976 | 9/1934 | Burnham et al. | 36/4 |
| 2,533,453 | 12/1950 | Gottschalk | 2/239 |
| 2,638,601 | 5/1953 | Bullard, III | 2/239 |
| 3,416,518 | 12/1968 | Samuels et al. | 2/239 |
| 3,600,717 | 8/1971 | McKeehan | 2/239 |
| 3,863,272 | 2/1975 | Guille | 2/239 |
| 4,294,022 | 10/1981 | Stockli et al. | 36/4 |
| 4,372,057 | 2/1983 | Nielsen | 36/10 |
| 5,421,034 | 6/1995 | Keune | 2/239 |
| 5,592,690 | 1/1997 | Wu | 2/239 |
| 5,596,770 | 1/1997 | Kunesh | 2/239 |
| 5,617,585 | 4/1997 | Fons et al. | 2/239 |
| 5,697,106 | 12/1997 | Baker et al. | 2/239 |
| 5,778,702 | 7/1998 | Wrightenberry | 2/239 |

*Primary Examiner*—Amy B. Vanatta
*Attorney, Agent, or Firm*—Young & Thompson

[57] ABSTRACT

The invention relates to a sock for wearing on a foot in a shoe, boot or the like.

If shoes, boots or the like are worn by different users one after the other, as for instance at bowling alleys, ice rinks, ski slopes etcetera, users can contract diseases and the like.

The invention provides a sock which is provided with an absorbent inner layer and an outer layer which contains an at least practically air and moisture-impermeable part.

1 Claim, 1 Drawing Sheet

SOCK

Figure 1A:
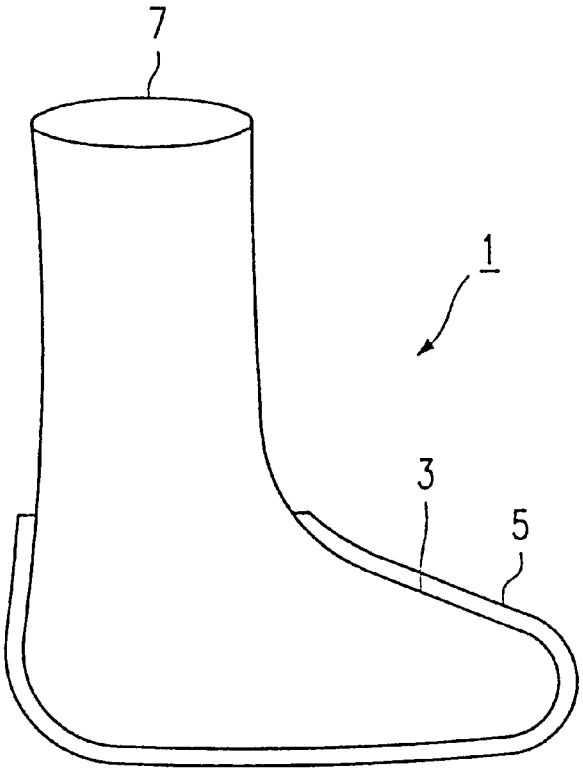

The invention relates to a sock for wearing on a foot in a shoe, boot or the like in order to protect the foot.

Such a sock is generally known and is practically always used by people when they wear shoes, boots and the like in order to keep the foot warm and protect the foot against roughness of the shoe, boot etcetera.

The existing socks suffice for normal use wherein the shoes and the like and the socks are always worn by one and the same person.

A drawback is that if the shoes and the like have to be worn by different people one after the other, as in the case of for instance hire shoes at bowling alleys, hire skates at ice rinks, hire ski shoes at (artificial) ski slopes, boots for the voluntary fire brigade and so on, problems can occur in respect of hygiene, transmitting of diseases to the feet and the like.

A further drawback is that a subsequent user perceives it as unpleasant if a previous user has perspired in the shoes, boots and the like.

The invention has as one of its objectives to provide a sock which does not have the above stated drawbacks. For this purpose a sock according to the invention has the feature that the sock contains an absorbent inner layer and an outer layer, which outer layer contains an at least practically air and moisture-impermeable part.

Thus is achieved that perspiration moisture and/or diseases such as athlete's foot and the like which may be present in the temporary user, cannot pass into the shoe, boot etcetera and thereby cannot infect etcetera a subsequent user. In addition, it is hereby virtually precluded that diseases which may be present in the shoe, boot etcetera can reach the user.

It is noted here that socks provided with an impermeable layer are known for use over shoes and the like in sterile areas such as operating theatres and in production areas for integrated circuits and so on.

An embodiment of a sock according to the invention has the feature that the impermeable part of the outer layer is situated at least on the bottom part of the sock. Providing the sock at least on the bottom part with the impermeable layer achieves that, at the location of the (possible) greatest perspiration of the foot, in any event neither perspiration moisture nor athlete's foot infections and the like can be transmitted to the shoe, boot etcetera.

An embodiment of a sock according to the invention has the feature that the inner layer contains polypropylene. An inner layer is hereby obtained which readily absorbs perspiration moisture and the like, whereby the comfort for the user is further increased.

A further embodiment of a sock according to the invention has the feature that the polypropylene has a density of about 10–50 gram per $m^2$. Tests have shown that good results are achieved herewith in terms of comfort and absorption capacity.

An embodiment of a sock according to the invention has the feature that the inner layer contains natural fibre such as for instance cotton, sisal or flax.

By using natural fibre a sock is obtained which absorbs perspiration moisture and the like to a large degree.

An embodiment of a sock according to the invention has the feature that the outer layer contains a natural or synthetic polymer material.

An outer layer is obtained herewith which is air and moisture-impermeable from the outside to the inside as well as from the inside to the outside.

A further embodiment of a sock according to the invention has the feature that the polymer material has a thickness of about 0.005–0.040 micrometre.

It has been found that polymer material of this thickness is sufficiently strong not to break and is on the other hand sufficiently thin to be elastic and comfortable in use.

An embodiment of a sock according to the invention has the feature that the polymer material contains polyethylene. Polyethylene has the advantage of being strong and also obtainable inexpensively.

An embodiment of a sock according to the invention has the feature that the polymer material contains polyvinyl chloride. Polyvinyl chloride also has the advantage of being strong and inexpensive.

An embodiment of a sock according to the invention has the feature that the polymer material contains latex. Latex can be manufactured naturally as well as synthetically and has the advantage that it is very flexible.

Figure 1B:
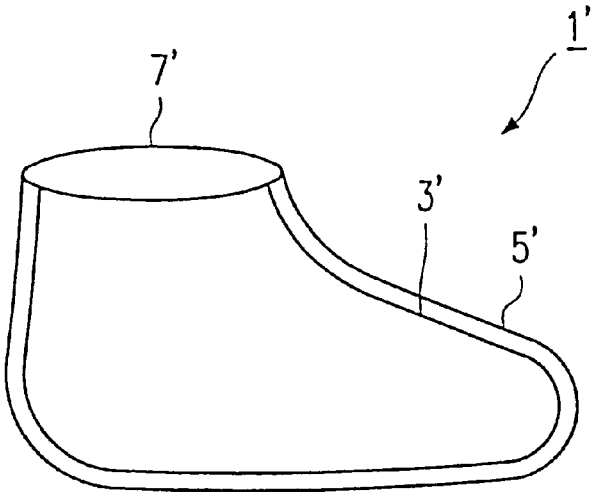

The invention will be further elucidated hereinbelow by way of example with reference to the annexed figures. Herein:

FIG. 1*a* shows an embodiment of a sock according to the invention for industrial use, and FIG. 1*b* shows a second embodiment of a sock according to the invention for recreational use.

FIG. 1*a* shows an embodiment of a sock 1 according to the invention, for instance for an industrial application and FIG. 1*b* an embodiment of a sock 1' according to the invention, for instance for recreational use.

In the embodiment as shown in FIG. 1*a* this sock has an inner layer 3 and an outer layer 5, wherein during wear the outer layer ends just above the foot. The sock further has a part above the foot to about just below the knee in use which ends with a for instance elastic, cord, glue layer or Velcro fastening 7 and which in this embodiment also protects the lower leg of the user in addition to the foot.

This sock can be pulled on simply over the normal socks and is particularly suitable for use in for instance boots of for instance the voluntary fire brigade.

In this embodiment the sock has only one layer above the foot, although it is also possible to continue the two layers to the top of the sock.

FIG. 1*b* shows a sock 1' which also has an inner layer 3' and an outer layer 5' and a fastening 7', although in this case the sock only reaches just above the ankle of the user during wear and is therefore primarily intended for use with shoes.

The sock according to the invention is intended to protect the feet of the temporary user of shoes, boots and the like which are also worn by others against perspiration moisture, athlete's foot and other foot diseases. The shoes, boots and the like in question are hereby also prevented from being contaminated by the temporary user. This can be important, among other instances, in bowling alleys where visitors are obliged to wear the shoes placed at their disposal, which shoes are successively worn by many users one after another, or to buy expensive bowling shoes.

This shoe can further be applied for the same purpose in the case of for instance ski shoe hire at (artificial) ski slopes, skate hire at skating rinks and so on. Particularly as a result of increasingly stringent product and service liability, it will be important for instance for bowling alley operators etcetera to prevent the possibility of visitors being infected by contaminated shoes made available by these operators.

Use of the sock according to the invention can also provide a solution in the case of for instance the voluntary fire brigade, where the suits as well as the boots are worn successively by different volunteers.

The inner layer 3, 3' can be constructed from different types of material. The object of the inner layer is to ensure that perspiration moisture et cetera from the foot is absorbed.

A possibility is to manufacture the inner layer from polypropylene, which in a preferred embodiment has a density of about 10–50 gram per $m^2$. Tests have shown that good results are obtained herewith both in terms of comfort and absorption capacity.

Another possibility is to manufacture the inner layer from natural fibre such as for instance cotton, sisal or flax. By using natural fibre a sock is also obtained which absorbs perspiration moisture and the like to a large degree.

The outer layer 5, 5' can also be constructed from different types of material such as for instance natural or synthetic polymer material. The object of the outer layer is to ensure that neither perspiration moisture nor athlete's foot etcetera can pass from inside the sock to the shoe, boot etcetera, nor from the shoe, boot etcetera to the foot.

A particular embodiment of the polymer material has a thickness of about 0.005–0.040 micrometre. Thus is achieved that the polymer material is sufficiently strong not to break and is on the other hand sufficiently thin to be elastic and comfortable.

Embodiments of polymer material which are suitable among others as material for the outer layer are polyethylene, polyvinyl chloride or latex.

The fastening 7, 7' can for instance be an elastic, cord, glue layer or Velcro fastening to enable comfortable wear of the sock.

It will be apparent that the height of the sock and of the impermeable outer layer can be adapted in accordance with the application, subject to the wishes and requirements in the relevant field of application.

Although the invention is elucidated with reference to these embodiments, it will be apparent to all that the invention is in no way limited to the given examples. On the contrary, many variations and manifestations will still be possible for a skilled person within the scope of the invention.

The sock according to the invention can be provided with a (thin) anti-slip layer on the underside of outer layer 5. Such a sock 1 can be used for instance in hotels, hospitals, aircraft etcetera. The anti-slip layer can be arranged in the materials polyethylene, latex, PVC and the like.

The material of the sock can also be embodied in vegetable and wholly degradable raw materials such as for instance starch, provided the outer layer is practically completely air and moisture-impermeable.

It will be apparent that the sock can be embodied such that it does not have a double-layered form everywhere It is thus possible for instance to provide the sock only partly with an outer layer (see FIG. 1*a*). It is also possible for the sock to be only partly provided with an inner layer, for instance only at the location where a foot loses considerable perspiration moisture. Other variants which are not shown in the examples also form part of the invention. It is thus simple for the skilled person in the field to manufacture variants wherein sock parts are fixed together by stitching, sealing, ultrasonic welding, laser beams etcetera. Many variations can also be envisaged in respect of the mutual connection of inner and outer layer.

We claim:

1. A knee sock comprising:

an innermost layer comprising a lower, foot-covering part with a closed toe-covering portion and an open ankle-covering portion, and an upper, tubular calf-covering part connected to the open ankle-covering portion so as to form an inner liner for the knee sock, both said parts comprising a moisture absorbent material so that the innermost layer is moisture absorbent; and an impermeable outer layer that is adhered to an entirety of an outer surface of the lower, foot-covering part of the innermost layer and that is not adhered to and does not cover the upper, calf-covering part, the outer layer comprising an air and moisture impermeable material so that the outer layer is air and moisture impermeable.

* * * * *